US005110412A

United States Patent [19]

Fuentes et al.

[11] Patent Number: 5,110,412

[45] Date of Patent: * May 5, 1992

[54] METHOD OF MANUFACTURE OF PAPER OR CARDBOARD USING RECYCLED FIBERS TREATED WITH ENZYMES

[75] Inventors: Jean-Luc M. Fuentes, Villenave D'Ornon; Michel M. Robert, Lacanau, both of France

[73] Assignee: La Cellulose Du Pin, Aubervilliers Cedex, France

[ * ] Notice: The portion of the term of this patent subsequent to May 8, 2007 has been disclaimed.

[21] Appl. No.: 653,975

[22] Filed: Feb. 11, 1991

Related U.S. Application Data

[63] Continuation of Ser. No. 326,637, Mar. 21, 1989, abandoned.

[30] Foreign Application Priority Data

Mar. 22, 1988 [FR] France ..... 88-03687

[51] Int. Cl.[5] ..... D21C 5/02

[52] U.S. Cl. ..... 162/5; 162/9; 162/13; 162/72; 162/100; 162/147; 162/158

[58] Field of Search ..... 162/9, 10, 5, 13, 72, 162/100, 158, 182, 147, 157.6

[56] References Cited

U.S. PATENT DOCUMENTS 3,041,246 6/1962 Bolaski et al. ..... 162/157.6
3,406,089 10/1968 Yerkes ..... 162/72
4,923,565 5/1990 Fuentes et al. ..... 162/72 B

FOREIGN PATENT DOCUMENTS 2604198 3/1988 France .

*Primary Examiner*—Peter Chin
*Attorney, Agent, or Firm*—Oblon, Spivak, McClelland, Maier & Neustadt

[57] ABSTRACT

The machinability of a papermaking composition of recycled fibers is improved by treating the fibrous composition with an enzyme preparation which acts on all or part of the cellulose fiber components, causing an improvement in the drainability of the water through the fibrous layer.

9 Claims, No Drawings

METHOD OF MANUFACTURE OF PAPER OR CARDBOARD USING RECYCLED FIBERS TREATED WITH ENZYMES

THis application is a continuation of application Ser. No. 07/326,637, filed on Mar. 21, 1989, now abandoned.

BACKGROUND OF THE INVENTION

1. Field of the Invention

This invention relates to the manufacture of paper and cardboard using recycled fibers 2. Background of the Prior Art Increasingly, the papermaking industry calls for raw materials based on recycled fibers. With each recycling, the quality of the raw materials deteriorates and, in order to achieve a satisfactory level in the mechanical characteristics of the paper or cardboard produced, it is generally necessary to carry out a refinement on the papermaking pulp.

The repercussions of these effects on the formations of sheets and the yield of the papermaking machine are important. In particular, there is observed a decrease in the capability of water to drain through the fibrous layer on repeated recycling.

It is then necessary to increase the concentration of the fibrous suspensions in order to retain a rate of manufacture which is comparable to the manufacture of sheets based on natural or bleached fibers, for example.

SUMMARY OF THE INVENTION

The invention proposes a method of manufacture of paper or cardboard using a paper machine, supplied with at least one jet of an aqueous suspension of recycled fibers onto the canvas of the paper machine, which enables the yield of the paper machine to be increased while providing a good formation of sheets.

In accordance with the method of the invention, prior to depositing the aqueous suspension of fibers onto the canvas, an enzyme preparation containing cellulases and/or hemicellulases and/or other enzymes having an action on all or part of the constituents of the recycled cellulose fibers acts on the papermaking composition based essentially on recycled fibers at a temperature of between 15 and 80° C, with a pH of between 3 and 8, and for a period of time greater than 5 minutes and preferably between 10 minutes and 1 hour, causing an improvement in drainability.

DETAILED DESCRIPTION OF THE INVENTION

The action of enzymes on papermaking pulps has already been described in several patent publications.

For example, French Patent Publication FR 2 557 894 teaches a method for treating papermaking pulps with an enzyme solution which promotes the refining of the pulp, that is which renders it capable of being transformed into a paper having defined characteristics. In accordance with this method, a particular enzyme solution containing xylanases acts on an unrefined pulp having a Schopper-Riegler (SR) degree which is fairly low, on the order of 10.

The method of this publication seeks, therefore, not to improve the draining of the treated pulp, but to improve its ability to be refined.

A method is also known, from Canadian Patent CA 758,488, for refining a papermaking pulp which consists of submitting an unrefined pulp to the action of an enzyme solution based in particular on cellulose, pectinol or lipase, and simultaneously for it to undergo mechanical refinement. The object sought is also improvement in the refinement of the treated pulp.

In accordance with the method of this invention, the action of the enzymes is different. In this case, they act on a pulp of recycled fibers which has poor machinability, due to poor drainability.

The action of the enzymes translates into an improvement in drainability which enables either a greater dilution of the papermaking composition in the head tank, or an increase in the speed of the machine and hence an increase in productivity, or both. The action of the enzymes also translates into an improvement in the mechanical characteristics of the sheet of paper manufactured from recycled fibers. It further translates into the fact that it permits the use, as raw materials, of a high percentage of very low category fibers, such as the category designated as bulk stock.

Thus, one of the aspects of the invention seeks to provide a method to improve the machinability of a papermaking composition during the manufacture of paper from a suspension of recycled fibers.

Another aspect of the invention seeks to provide a method for manufacturing a paper from a composition of recycled fibers containing a substantial percentage of very low category fibers, much lower quantities of which are normally incorporated in the conventional methods of manufacturing paper since they are highly detrimental not only to the drainability of the resulting fibrous suspensions but also to the mechanical properties of the papers produced from said fibrous suspensions.

Among all the enzyme preparations containing cellulases and/or hemicellulases and others, such as esterases, mananases, etc., which are used in accordance with the invention, those having a $C_1$ activity, a $C_x$ activity and a xylanase activity are preferably selected.

These three activities are defined by the international nomenclature of enzymes and they ca be qualified and expressed in units of the international system per milligram of powder of the enzyme preparation under consideration. The $C_1$ activity is the action of the cellobiohydrolase capable of being administered onto very organized, pure cellulose. This activity is manifested by the production of cellobiose and the international system has taken the AVICEL substrate as the reference substrate. The $C_x$ activity is administered onto modified cellulose, for example carboxymethylcellulose, and it is quantified by a decrease in the viscosity of the carboxymethylcellulose or an increase in reducing activities. The xylanase activity enables hydrolysis of the bonding xylanes.

The enzyme preparation is used with an enzyme concentration which varies depending on the $C_1$, $C_x$ or xylanase activities of the enzymes contained in the preparation. Thus, the enzyme preparation is preferably used at a concentration of 0.01% to 2% by weight of the dry pulp, with these percentages corresponding to a preparation of having a $C_1$ activity of 0.168 USI per milligram of powder, a $C_x$ activity of 3.9 USI milligram of powder and a xylanase activity of 31 USI per milligram of powder.

It goes without saying that the concentrations of enzyme preparations can be modified depending on the type of preparation used. Nevertheless, generally with the enzyme preparations whose activities have been described above, below a concentration equal to approximately 0.01% by weight of dry pulp, there is no significant effect, except to prolong the reaction time up to times which are unsuitable for industrial production rates. Beyond a concentration equal to approximately 2% by weight of dry pulp, the cost of the operation tends to become prohibitive and the mechanical characteristics of the manufactured paper tend to be lowered.

The reaction medium can be more or less suited to the action of the enzymes. Temperature and pH conditions are more particularly appropriate to prevent any risk of denaturing the enzymes by the medium. The pH is therefore between 3 and 8 and the temperature between 15° C. and 80° C. Over 80° C., the medium tends to denature the enzyme, and below 15° C., the action of the enzymes takes place particularly slow.

Rather than seeking to modify the reaction medium to adapt it to the action of the enzymes, the method in accordance with the invention proposes preferably adapting the enzyme preparation to the industrial operating conditions generally used in papermaking, that is, without other modifications of the manufacturing process.

Other advantages and characteristics of the invention will become apparent from the following description of the examples of embodiments. Examples 1 to 15 show the action of enzyme preparations on the drainability of papermaking compositions based on recycled fibers.

Examples 16 to 20 show the advantages, and in particular the increases in productivity, brought about by the invention on an industrial machine.

EXAMPLES 1-12

An aqueous suspension of papermaking pulp based on recycled fibers was prepared in the following manner.

1 kg was weighed dry of a pulp composed solely of fibers from recycled cardboard cartons.

From this was made a 3% by weight aqueous suspension by adding water up to a total weight of 33.333 kg. The pH of the suspension was adjusted to the desired value by adding either sulfuric acid ($H_2SO_4$, 1N) to obtain acid pH, or sodium hydroxide (NaOH, 1N) to obtain basic pH. A preferred method of working was to control the pH using a pH-meter when either the acid or the base was added, at the same time homogenizing the fibrous suspension. The fibrous suspension was brought to the desired temperature. Once this temperature was reached, 1.6 ml of an enzyme solution was added, which solution was based on cellulases and hemicellulases, sold under the name MULTIFECT L250 by Finnish Sugar Co. Ltd. The enzymes were allowed to react for a variable time depending on the examples and drainability of the papermaking suspensions was measured using a Britt-Jar apparatus in accordance with the protocol described below. In this manner, the drainability was measured prior to the introduction of the enzymes and after the treatment.

To measure the drainability, a suspension of papermaking fibers was prepared with a concentration of 10 g/l and 650 ml of this suspension were poured into the Britt-Jar apparatus which comprises a cylindrical body with a diameter of 10.2 centimeters at the base of which is a filtering canvas of the same type and characteristics as the canvas of the paper machine. This apparatus is sold for example by the Novipro Company. Drainage (or drainability) is the name given to the volume of water which has passed through the canvas after 15 seconds under a vacuum of 0.2 bars, without stirring of the aqueous suspension.

In this example, the drainability measurement before the introduction of the enzymes was 320.

Thus, 12 examples were carried out of treatments which were different from one another in temperature, pH or time of treatment. The conditions, as well as the results, are shown in Table I below.

EXAMPLES 13 TO 15

The methods used in Examples 1, 5 and 10, respectively, were repeated, except that the enzyme preparation of these examples was replaced by another preparation, that is an aqueous solution of a Maxazyme CL 2000 powder sold by the French company Rapidase.

TABLE I

| Example No. | Temperature °C. | pH | Reaction Time In Hours | Drainability After Treatment |
|---|---|---|---|---|
| 1 | 50 | 5 | 0.5 | 510 |
| 2 | 50 | 6 | 0.5 | 510 |
| 3 | 50 | 7 | 1 | 420 |
| 4 | 40 | 5 | 1 | 510 |
| 5 | 40 | 6 | 1 | 500 |
| 6 | 40 | 7 | 1 | 485 |
| 7 | 40 | 7.5 | 2 | 485 |
| 8 | 25 | 5 | 2 | 475 |
| 9 | 25 | 6 | 2 | 465 |
| 10 | 25 | 7 | 2 | 475 |
| 11 | 25 | 7.5 | 2 | 435 |
| 12 | 50 | 4 | 1 | 485 |
| 13 | 50 | 5 | 0.5 | 500 |
| 14 | 40 | 6 | 1 | 485 |
| 15 | 25 | 7 | 2 | 475 |

The 15 examples show that the treatment of the suspension using enzymes provides an increase in the drainability of the fibrous suspension, which leads to greater drainage speed and, therefore, better machinability.

EXAMPLE 16

In this example, it was sought to manufacture paper for covering cardboard boxes with a gram weight of 125 g/m$^2$, by using an industrial paper machine.

The fibrous starting composition was composed of 95% by weight of recycled cardboard boxes and 5% by weight of bulk stock. Using a pulper, an aqueous suspension with 30 g/l was made continuously. This suspension then passed through various conventional purifiers and stocking tubs. In the last of said tubs, while the suspension of the fibers was at a temperature of 45° C. and a pH of 6, an enzyme preparation based on cellulases and hemicellulases was added at a rate of 1.2 liters per dry ton of paper product in the form of a solution sold under the name MULTIFECT L250 by Finnish Sugar Co. Ltd. this was allowed to react during the time of passage of the suspension in the tub, which corresponded to approximately 30 minutes.

The suspension treated by the enzymes was them sent to the head tank, where it was brought to a concentration of 7.4 g/l.

The composition was poured onto the canvas of the paper machine which moved at a speed of 250 m/min.

In this manner, a production of 4.15 tons/hour of covering paper was obtained.

The burst index was measured in accordance with standard NFQ 03053. This index represents the quotient of the maximum pressure distributed uniformly, and supported by a paper test piece, perpendicular to its surface, by the gram weight of the paper. In this example, a burst index of 1.79 was found.

COMPARATIVE EXAMPLE 16

The method of Example 15 was used, except that no enzyme treatment was carried out. The concentration in the head tank was 9.5 g/l so as to obtain the best compromise between appropriate drainability and maximum production. The production obtained was 3.89 tons/-hour.

The burst index of the paper manufactured was 1.64.

This comparative examples show the advantages provided by the invention: greater dilution in the head tank and an increase in the speed of the machine, which translates into increased productivity. An improvement in the characteristics of the paper is also observed.

EXAMPLE 17

The method of Example 15 was repeated, except that the concentration in the head tank was modified while retaining the same concentration as in comparative example 16 and increasing the speed of the machine to bring it to 255 m/min. The production reached 4.22 tons/hour.

The burst index measured was 1.65.

From a comparison with comparative example 15, it can be noted that the treatment using enzymes enables the speed of the machine to be increased considerably without a loss of the mechanical characteristics of the paper.

EXAMPLE 18

In this example, the method of example 16 was repeated, but modifying the fibrous composition which, in this case, is formed of 80% recycled cardboard boxes and 20% bulk stock.

The concentration in the head tank was 8.5 g/l and the speed of the machine was 241.8 m/min.

The machine production of paper was 4.01 tons/-hour.

The burst index measured was 1.65.

From a comparison with comparative example 16, it can be noted that in addition to increased production, it is possible to increase the quantity of bulk stock (the lowest quality) and to decrease the cost of manufacturing the paper while retaining satisfactory mechanical characteristics.

Through the action of the enzymes improving the drainability of the fibrous suspension, the dilution in the head tank can be increased and, therefore, the formation of the sheet can be improved.

EXAMPLE 19

An ordinary 190 g/m$^2$ covering paper was manufactured from a fibrous composition of 80% box scrap and 20 good cardboard.

The method of example 15 was repeated using a quantity of enzymes of 0.9 l/ton of dry paper product.

The concentration in the head tank was 8.6 g/l and the speed of the machine was 163.3 m/min. The production of paper was 3.92 tons/hour.

The burst index measured was 2.33.

COMPARATIVE EXAMPLE 19

The method of example 19 was used, except that the papermaking composition was not treated with enzymes.

The concentration in the head tank for the best drainability-production compromise was 10.5 g/l and the speed of the machine was 153.6 m/min. The paper production was 3.69 tons/hour and the burst index was 2.14.

This comparative example shows the advantages provided by the invention with regard to the productivity and the characteristics of the paper with another starting papermaking composition. The treatment with an enzyme preparation based on cellulose and/or hemicellulose enables greater dilution in the head tank, which improves sheet making while increasing the speed of the machine.

EXAMPLE 20

The manufacture of a "test liner" paper of 180 g/m$^2$ was desired.

The method of Example 16 was used, but the starting composition was 80% box scrap and 20% kraft bags. The quantity of enzymes was 0.65 l/ton of paper product.

The concentration in the head tank was 8.5 g/l and the speed of the machine was 152.3 m/min.

The production of paper was 3.78 tons/hour.

The burst index measured was 2.84.

COMPARATIVE EXAMPLE 20

The method of example 20 was used, except that the papermaking composition was not treated with the enzymes.

The concentration in the head tank for the best drainability-production compromise was 10.2 g/l and the speed of the machine was 151.4 m/min. The production of paper was 3.61 tons/hour and the burst index was 2.75.

In example 20 the previously described advantages can be seen.

The invention has been described above with reference to specific examples. These are not intended to be limiting. In particular, different enzyme preparation, different stock, and other variations will occur to those or ordinary skill, without departing from the scope of the invention as set forth in the claims appended hereto.

What is claimed is:

1. A method for the manufacture of paper or cardboard from an aqueous suspension of fibers containing a majority of recycled cellulose fibers, said method comprising depositing the aqueous suspension of said fibers onto a forming fabric, wherein, prior to the deposit of the suspension onto the forming fabric, the fibers are treated with an amount of an enzyme sufficient to increase drainability of said suspension, said enzyme being selected from the group consisting of cellulases, hemicellulases, and other enzymes having $C_1$, $C_x$ or xylanase activity and acting on all or part of the constituents of the cellulose fibers, and mixtures thereof, at a temperature of between 15° and 80° C. and at a pH of between 3 and 8, for a period of greater than 5 minutes, thereby causing an improvement in the drainability of said suspension.

2. The method of claim 1, wherein said treatment period is from 10 minutes to 1 hour.

3. A method for the treatment of an aqueous suspension of fibers containing a majority of recycled cellulose fibers to improve the drainability thereof, said method comprising treating said fibers with an amount of an enzyme sufficient to increase the drainability of said suspension, said enzyme being selected from the group consisting of cellulases, hemicellulases, and other enzymes having $C_1$, $C_x$ or xylanase activity and acting on all or part of the constituents of the cellulose fibers, and mixtures thereof, at a temperature of between 15° and 80° C. and at a pH of between 3 and 8, for a period of greater than 5 minutes, thereby causing an improvement in the drainability of said suspension.

4. The method of claim 1, wherein the enzyme preparation contains cellulases, hemicellulases, or mixtures thereof.

5. The method of claim 1, wherein the aqueous suspension of fibers is formed of 100% recycled cellulose fibers.

6. The method of claim 1, wherein said recycled cellulose fibers contain from 0 to 25% of the lowest category of recycled cellulose fibers.

7. The method of claim 1, wherein the enzyme preparation is used at a concentration of 0.01% to 2% by wt. of dry pulp.

8. The method of claim 1, wherein the enzyme preparation in powder form has a $C_1$ activity of 0.168 USI per milligram of powder, a $C_x$ activity of 3.9 USI per milligram of powder, and a xylanase activity of 31 USI per milligram of powder.

9. The method according to claim 3, wherein the enzyme preparation in powder form has a $C_1$ activity of 0.168 USI per milligram of powder, a $C_x$ activity of 3.9 USI per milligram of powder, and a xylanase activity of 31 USI per milligram of powder.

* * * * *